US007007937B2

(12) United States Patent
Foshag et al.

(10) Patent No.: US 7,007,937 B2
(45) Date of Patent: Mar. 7, 2006

(54) CLAMP-TYPE HAND TOOL

(75) Inventors: Siegfried Foshag, Neuhausen (DE); Gerhard Kloepfer, Pleidelsheim (DE); Hans Roesch, Gemmrigheim (DE)

(73) Assignee: Bessey & Sohn GmbH & Co. KG, Bietigheim-Bissingen (DE)

( * ) Notice: Subject to any disclaimer, the term of this patent is extended or adjusted under 35 U.S.C. 154(b) by 0 days.

(21) Appl. No.: 10/965,219

(22) Filed: Oct. 13, 2004

(65) Prior Publication Data

US 2005/0087918 A1 Apr. 28, 2005

(30) Foreign Application Priority Data

Oct. 27, 2003 (DE) ..... 103 51 224

(51) Int. Cl.
*B25B 1/00* (2006.01)

(52) U.S. Cl. ..... 269/6; 29/268

(58) Field of Classification Search ..... 269/6, 269/3; 81/360, 32; 29/268, 278
See application file for complete search history.

(56) References Cited

U.S. PATENT DOCUMENTS

| | | | | |
|---|---|---|---|---|
| 4,944,204 A | 7/1990 | West | | |
| 5,408,904 A * | 4/1995 | Neff | ..... | 81/360 |
| 6,026,716 A * | 2/2000 | Orlosky | ..... | 81/360 |
| 6,237,449 B1 * | 5/2001 | Orlosky | ..... | 81/360 |
| 6,648,314 B1 * | 11/2003 | Degen et al. | ..... | 269/6 |
| 2005/0087918 A1 * | 4/2005 | Foshag et al. | ..... | 269/6 |

FOREIGN PATENT DOCUMENTS

| | | |
|---|---|---|
| DE | 297 18 160 | 1/1998 |
| DE | 297 13 482 | 2/1998 |
| DE | 196 49 714 | 6/1998 |
| FR | 1 505 462 | 10/1966 |

OTHER PUBLICATIONS

Koller, R., et al., "Ein Weg zu einer systematischen Konstruktion und Ordnung von Schnappverbindungen", Konstruktion 39 (1987) H.8, pp. 315-320.

* cited by examiner

*Primary Examiner*—Lee D. Wilson
(74) *Attorney, Agent, or Firm*—Lipsitz & McAllister, LLC

(57) ABSTRACT

In order to improve a clamp-type hand tool, comprising a first arm incorporating a corresponding jaw portion and a second arm incorporating a corresponding jaw portion wherein the two arms are pivotable relative to one another and the jaw portions form a jaw device having an adjustable aperture, in such a manner that it is employable in as universal a way as possible, it is proposed that the jaw portion of the first arm and/or the law portion of the second arm be displaceable on the corresponding arm.

29 Claims, 8 Drawing Sheets

CLAMP-TYPE HAND TOOL

The present disclosure relates to the subject matter disclosed in German application No. 103 51 224.1 of Oct. 27, 2003, which is incorporated herein by reference in its entirety and for all purposes.

BACKGROUND OF THE INVENTION

The invention relates to a clamp-type hand tool, comprising a first arm with a corresponding jaw portion and a second arm with a jaw portion, wherein the two arms are pivotal relative to one another and the jaw portions form a jaw device having an adjustable aperture.

Clamp-type hand tools of this type are employed in order to clamp one or more work-pieces and, in particular, to keep them clamped in the jaw. They are also referred to as C-clamps, spring clamps or glue clamps. In particular, they can be operated with one hand.

SUMMARY OF THE INVENTION

In accordance with the invention, a clamp-type hand tool is provided that is employable in a universal manner.

In accordance with the invention, the jaw portion of the first arm and/or the jaw portion of the second arm are displaceable on the appertaining arm.

As a result of the jaw portion or the jaw portions being displaceable on the appertaining arm or the appertaining arms, it becomes possible to provide a further form of adjustment for the clamp-type hand tool; the size of the aperture can be set by the pivotal position of the two arms relative to one another and additionally or alternatively by the displaced position of the jaw portion or the jaw portions on the appertaining arm or the appertaining arms.

The clamp-type hand tools known from the state of the art have the disadvantage that the clamping force, which is effective on a clamped work-piece, is dependent on the size of the aperture formed by the jaw. The clamping force is usually smaller with smaller apertures than it is with larger apertures; this is due to the force-extension characteristic of the springs that are usually employed and which produce the clamping force. Since, in the case of the teaching in accordance with the invention the aperture can also be adjusted by means of the displaced position of the jaw portion or the jaw portions, the force that is exerted on a clamped work-piece can also be adjusted by such a displacement of the jaw portion or portions. Thus, for example, a certain force, which is effective on the work-piece, can be set for an aperture of given size. In analogous manner, a certain clamping force can be obtained for different sized apertures.

By virtue of the teaching in accordance with the invention, there is provided an additional form of adjustment with the aid of which the clamping force can be proportioned. This additional form of adjustment can be implemented in a constructionally simple manner.

The aperture of the jaw device formed by the two jaw portions can be adjusted over a larger clamping range whilst maintaining the constructional size with regard to the handle portions—and thus the single-handed operability of the tool—by means of said at least one displaceable jaw portion. In particular, the apertures can be adjusted in a manner such as is only known from clamps or cramps that are not operable in single-handed manner.

In particular, the displaceable jaw portion is displaceable away from the other jaw portion or is displaceable towards the other jaw portion. The distance between the displaceable jaw portion and a pivotal bearing for the two arms is adjustable. The aperture of the jaw device is adapted to be adjusted in this manner by the displacement of the jaw portion or the jaw portions.

In addition to or as an alternative to the setting of the aperture by means of a certain pivotal position of the two arms, the aperture of the jaw device is then able to be adjusted by means of the displaceable jaw portion, whereby the clamping force that is being exerted on a clamped work-piece is adjustable.

In the case of the teaching in accordance with the invention, the clamping force, which is applied to one or more work-pieces that are clamped in the jaw, is adjustable by means of the displaceable jaw portion. Thus the force, which is exerted on one or more work-pieces, is adapted to be proportioned.

It is advantageous, if the jaw portion is guided such as to be displaceable and fixable on the appertaining arm. Thus defined apertures can be set, whereby the position of the jaw portion on the appertaining arm is rigidly set.

It is expedient if one direction of displacement of the displaceable jaw portion is transverse and in particular perpendicular to a pivotal axis for the first arm and the second arm. In this way, the aperture can be adjusted in a simple manner by means of the displaced position of the displaceable jaw portion or the displaceable jaw portions.

For the same reason, it is expedient if one direction of displacement of the displaceable jaw portion is transverse and in particular perpendicular to a longitudinal direction of a handle portion of the appertaining arm. Displacement of a jaw portion can be implemented in a simple manner, if a slide rail is provided for the displaceable jaw portion. Such a slide rail can be manufactured in a simple manner in order to provide a means for guiding the displacement. Furthermore, the displacement of the corresponding jaw portion can be achieved in a simple manner.

It is expedient, if the slide rail extends transversely and in particular perpendicularly relative to a handle portion of the associated arm. The jaw portion can thus be displaced in a direction transverse and in particular perpendicular to the handle portion.

In particular, provision is made for the slide rail to be connected to a handle portion of the associated arm. The connection may be effected in one-piece manner or it may consist of separate components which are subsequently fixed to one another. A certain pivotal position of the arms for adjusting the aperture of the jaw can be obtained by means of the handle portion (in conjunction with a handle portion of the other arm). By positioning the jaw portion on the slide rail, this aperture can be varied or a clamping force can be set for a given size of aperture especially in conjunction with a change in the pivotal position of the arms.

In one embodiment, the displaceable jaw portion is in the form of a sliding bracket which is guided on the slide rail. A means for guiding the displacement process can thus be implemented in a simple manner, whereby, in particular, a certain displacement position can be defined.

Such a definition of the position can be implemented in a simple manner if the sliding bracket is adapted to be fixed to the slide rail in releasable manner by means of a clamping force. The clamping force holds the sliding bracket in a set displacement position in such a way that it can only be displaced if the clamping force is removed. In order to release the clamping force, it is preferable that the direction of the necessary force be transverse relative to the direction of displacement.

A clamping force can be implemented in a simple manner if one or more elastic elements (spring elements) are provided in order to hold the sliding bracket on the slide rail. Apart from being fixed in a displaced position by means of the elastic (resilient) elements, the sliding bracket can also be pressed thereby into a retaining position, in which it is essentially free from play, from a transitional phase during the displacement process.

In particular, there is provided at least one springy tongue element which presses the sliding bracket onto the slide rail and thus presses a latching element into a seating. The tongue element preferably exerts a normal force and a force along the direction of displacement. The sliding bracket can thus be pressed into a retaining position and held therein in an essentially play-free manner.

The at least one tongue element is preferably arranged on the sliding bracket and, for example, is formed in one-piece with the sliding bracket. If the sliding bracket is made of a synthetic material, then an appropriate tongue element can be formed in one-piece therewith in a simple manner.

A fixing device can be manufactured in a simple manner if the sliding bracket comprises one or more latching elements and the slide rail comprises matching seatings, whereby a displacement of the sliding bracket will be blocked if the at least one latching element has entered a seating. When force is exerted in the direction of displacement, the latching element strikes against a wall of the seating and its movement is blocked. In order to extract the latching element from a seating, it will be necessary to expend energy whenever a latching element is held, in the manner of a latching arrangement, in an associated seating by means of a clamping force. The direction of the necessary force is transverse to the direction of displacement in order to extract a latching element from a seating (and thus, in order to enable a displacement of the sliding bracket).

In particular, there is provided a row of seatings, in the manner of a wave structure for example, in order to enable a plurality of fixing positions to be provided along the direction of displacement and thereby enable the distance between neighboring (discrete) fixing positions to be kept small. Fixing in a retaining position and release from a retaining position can be achieved in a simple manner, if the seatings and a surface, upon which a force-exerting element such as a springy tongue element is effective, are arranged on opposite sides of the slide rail. The sliding bracket can thereby be pressed into a seating with the aid of a latching element, and a latching element can be extracted from a seating by exerting a counter force in order to release it from the retaining position.

It is expedient, if the seatings have side faces which are inclined with respect to the direction of displacement. Hereby, the side faces need not be plane, but could also be curved. In the case of inclined side faces, a corresponding latching element will be pressed into a potential minimum when a force having a component of force parallel to the direction of displacement is exerted. A retaining position that is essentially free from play can thereby be implemented. It is preferable if a seating is then designed as a kind of hollow with inclined side walls.

Provision may be made for the slide rail to be provided with a graduated scale. This facilitates the defined setting of a displacement position for the sliding bracket on the slide rail, or, for the slide rail on the associated arm.

As an alternative or in addition thereto, provision may also be made for the slide rail to be arranged on the associated arm in displaceable and fixable manner. The slide rail is a slide rail in the sense that it is guided on the associated arm i.e. it can "slide" on the associated arm. The corresponding jaw portion of the arm is then displaceable by virtue of the slide rail being displaced together with the jaw portion. The advantages already described hereinabove thereby result; in particular, the clamping force on one or more work-pieces in the jaw device is adjustable.

Hereby, the jaw portion can be seated firmly or rigidly on the displaceable slide rail by, for example, being formed in one-piece manner with the slide rail, or it can be fixed thereto by fixing means such as screws or bolts. However, it is also possible for the jaw portion itself to be seated on the displaceable slide rail such that it too is fixable and displaceable. A relative spacing between the jaw portion and the pivotal bearing can then be set in two different ways, namely, by adjustment of the position of the jaw portion on the slide rail and by adjustment of the position of the slide rail on the associated arm. In this case, the slide rail is a slide rail having a double meaning, since the jaw portion, which is especially designed as a sliding bracket, is adapted to be fixed and displaced on the rail, whilst, on the other hand, the slide rail itself is adapted to be fixed and displaced on the arm.

In particular, provision is then made for the associated arm to comprise a guidance recess for the slide rail in order to allow a relative displacement between the slide rail (including the jaw portion) and the arm to occur. Hereby, as described hereinabove, elastic elements may be provided in order to provide for the marking of defined retaining positions of the slide rail on the arm.

In order to implement a clamping means, a spring, such as a torsion spring or a leg spring for example, is preferably arranged between the first arm and the second arm. The spring is then responsible for a clamping force which will hold one or more work-pieces between the jaw portions of the jaw device.

The spring is preferably arranged and constructed in such a manner that an external expenditure of energy will be necessary in order to pivot the arms relative to one another such as to produce an enlargement of the aperture of the jaw device. In the absence of the exertion of an external force, the spring then squeezes the two arms apart and thus squeezes the jaw portions together. When the handle portions of the arms are squeezed together by the exertion of an external force, the spring will then be squeezed together and the jaw device will open. A clamping force is then effective on the work-piece by virtue of the jaw portions being seated thereon when a work-piece is inserted into the jaw.

The spring is, for example, formed as leg spring with at least one leg. It can have a spring winding or spring winding package with several windings. The at least one leg of the spring can be positioned on a handle portion of the corresponding arm and in particular on an inner surface which is directed towards the handle portion of the other arm. Such, the spring can be positioned and secured in a safe and simple manner.

In particular, a spring winding package comprising at least one winding is formed between a first leg and a second leg.

The spring winding or spring winding package can be arranged over a pivotal element via which a shaft or a pivotal bearing for the pivotal movement of the arms is formed.

In particular, the spring is arranged and constructed in such a manner that the arms will exert a clamping force on one or more work-pieces which are located between the jaw portions of the two arms.

It is of quite particular advantage, if a jaw piece for a work-piece is arranged in moveable manner on the jaw portion of the first arm and/or of the second arm and, in particular, if it is arranged such as to be pivotal about a pivotal axis parallel to the pivotal axis for the pivotal movement of the two arms. A firm seating of the jaw portions on a work-piece can thus be obtained independently of the size of the aperture of the jaw device.

The following description of a preferred embodiment will serve for a more detailed explanation of the invention in conjunction with the drawing.

BRIEF DESCRIPTION OF THE DRAWINGS

FIG. 4);

DETAILED DESCRIPTION OF THE INVENTION

Figure 1:
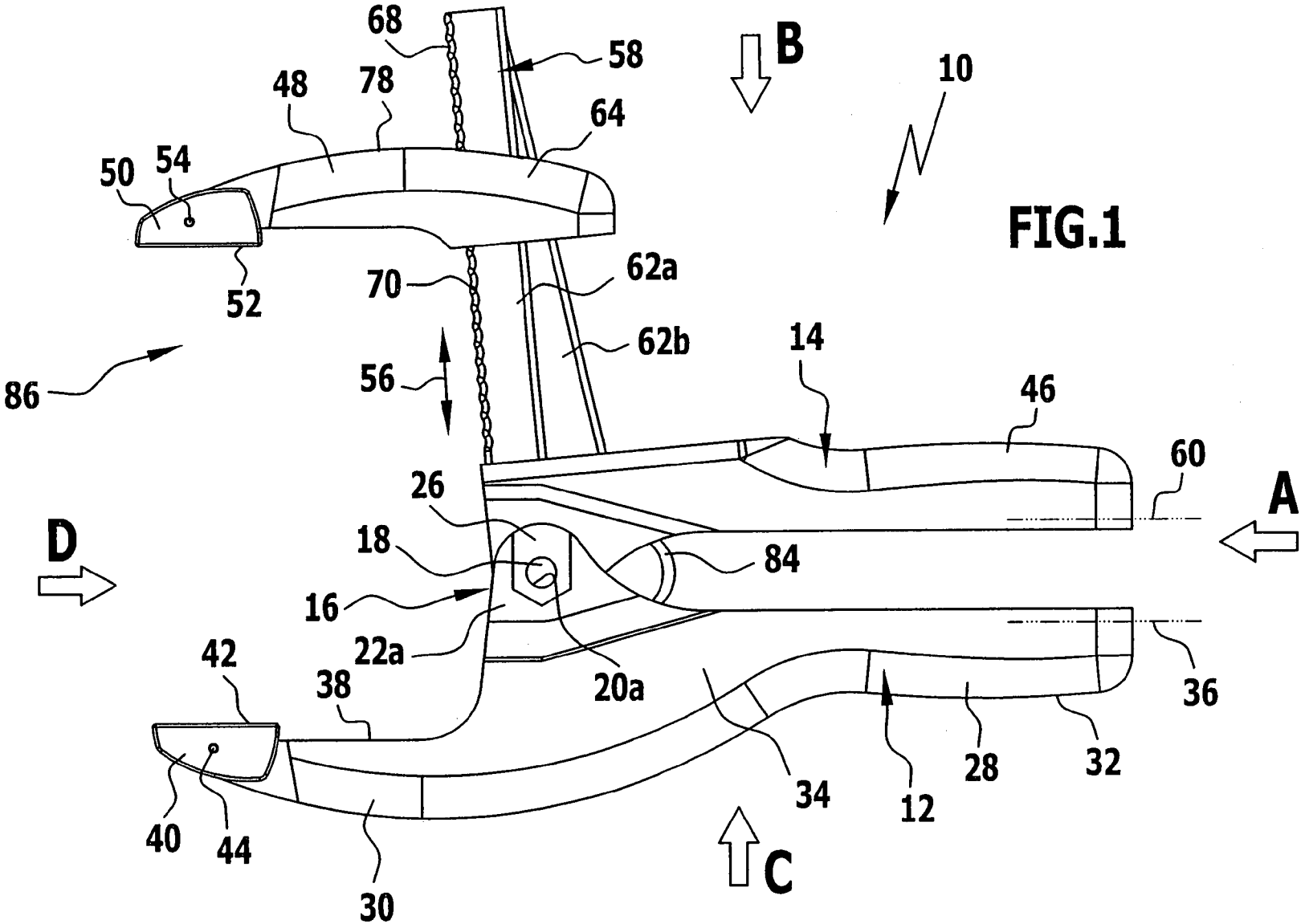
FIG. 1 shows a plan view of an exemplary embodiment of a clamp-type hand tool in accordance with the invention.
Figure 2:
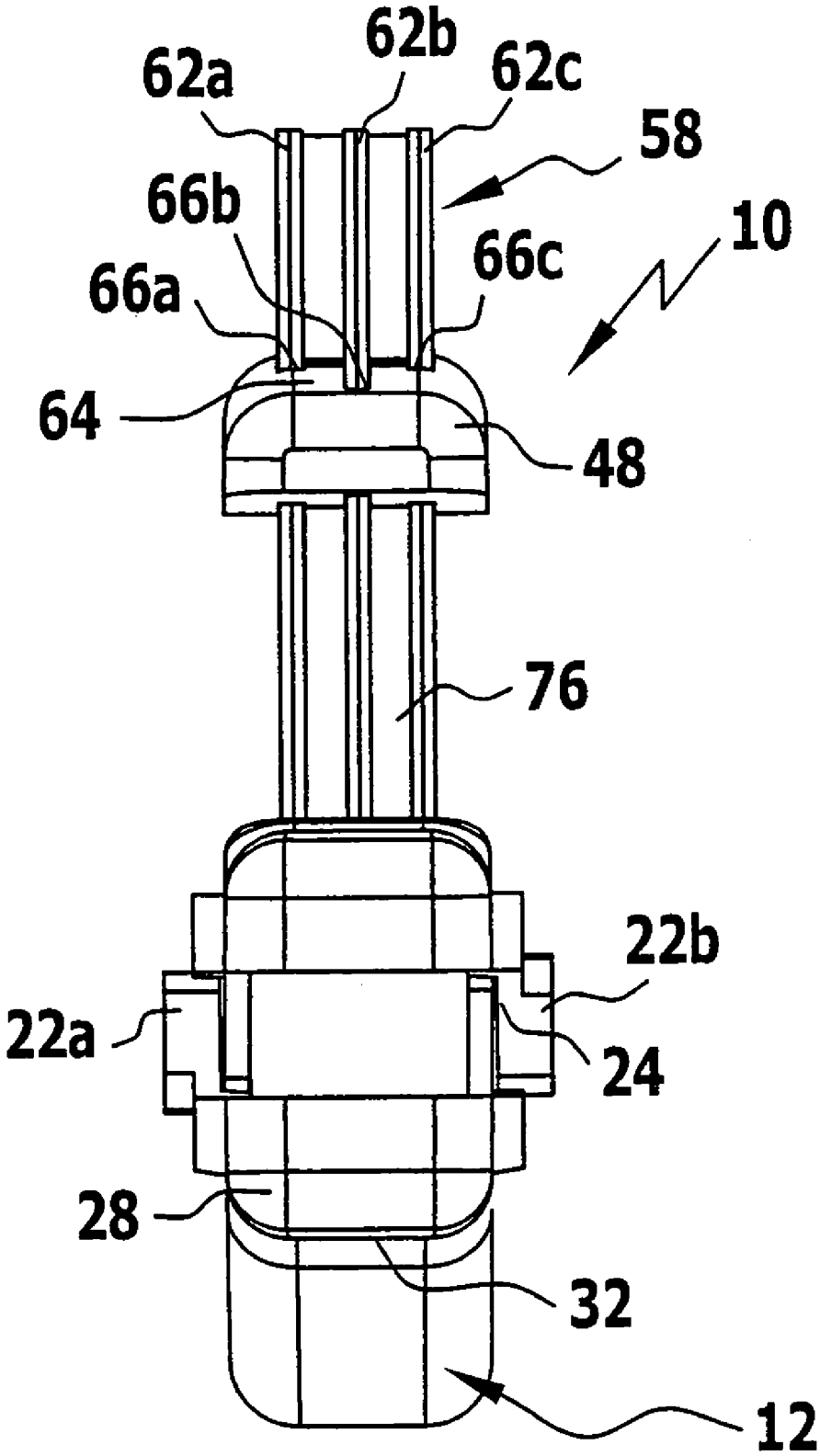
FIG. 2 a view of the clamp-type hand tool in accordance with FIG. 1 in the direction A.

An exemplary embodiment of a clamp-type hand tool in accordance with the invention, which is shown in FIGS. 1 to 7 and bears the general reference 10 in FIG. 1, comprises a first arm 12 and a second arm 14. The two arms 12, 14 are pivotal relative to one another. A pivotal bearing 16 comprising a pivotal shaft 18 is provided for this purpose.

Figure 6:
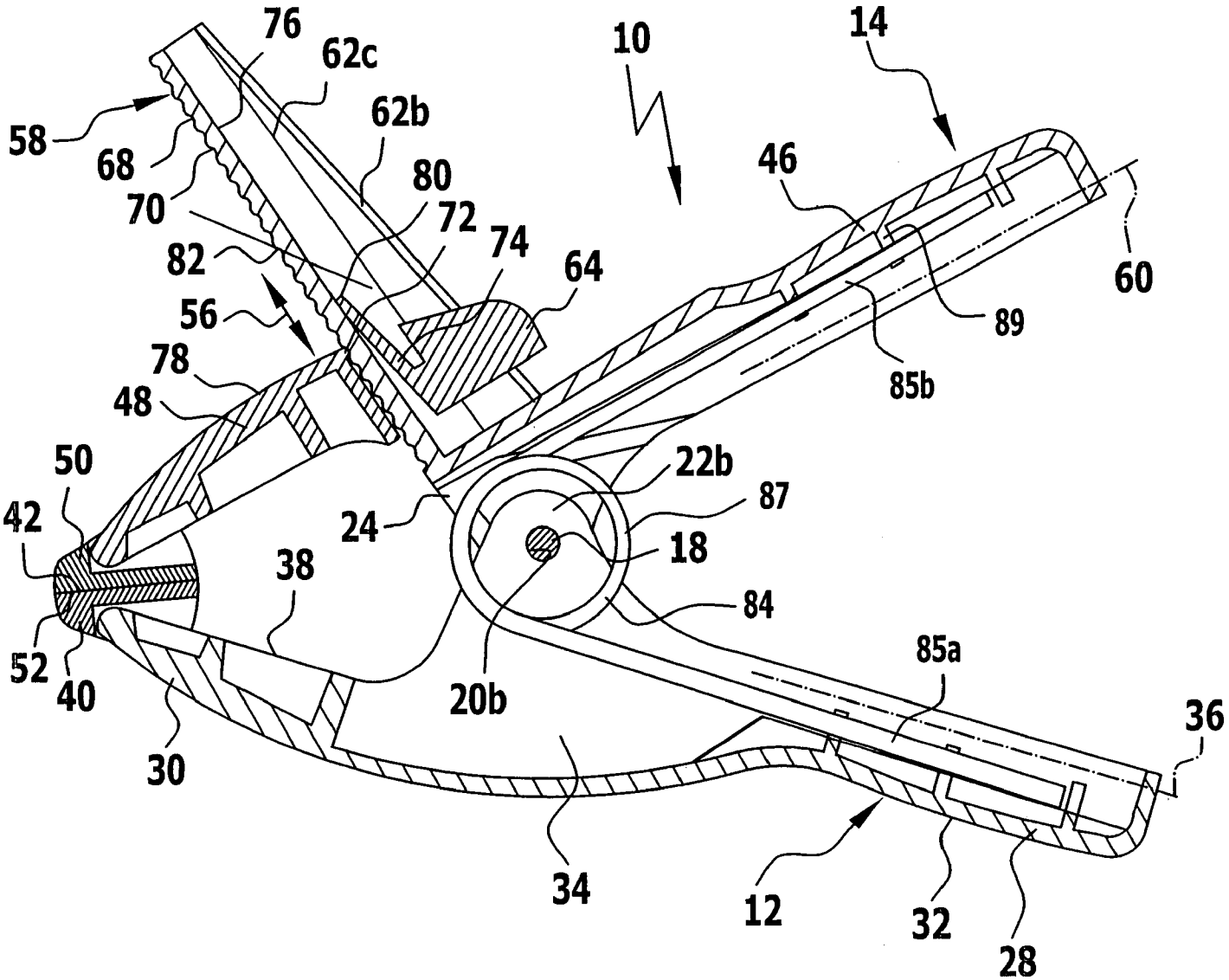
FIG. 6 a sectional view of the clamp-type hand tool in accordance with FIG. 1 along the line 6—6 (c.f.
Figure 7:
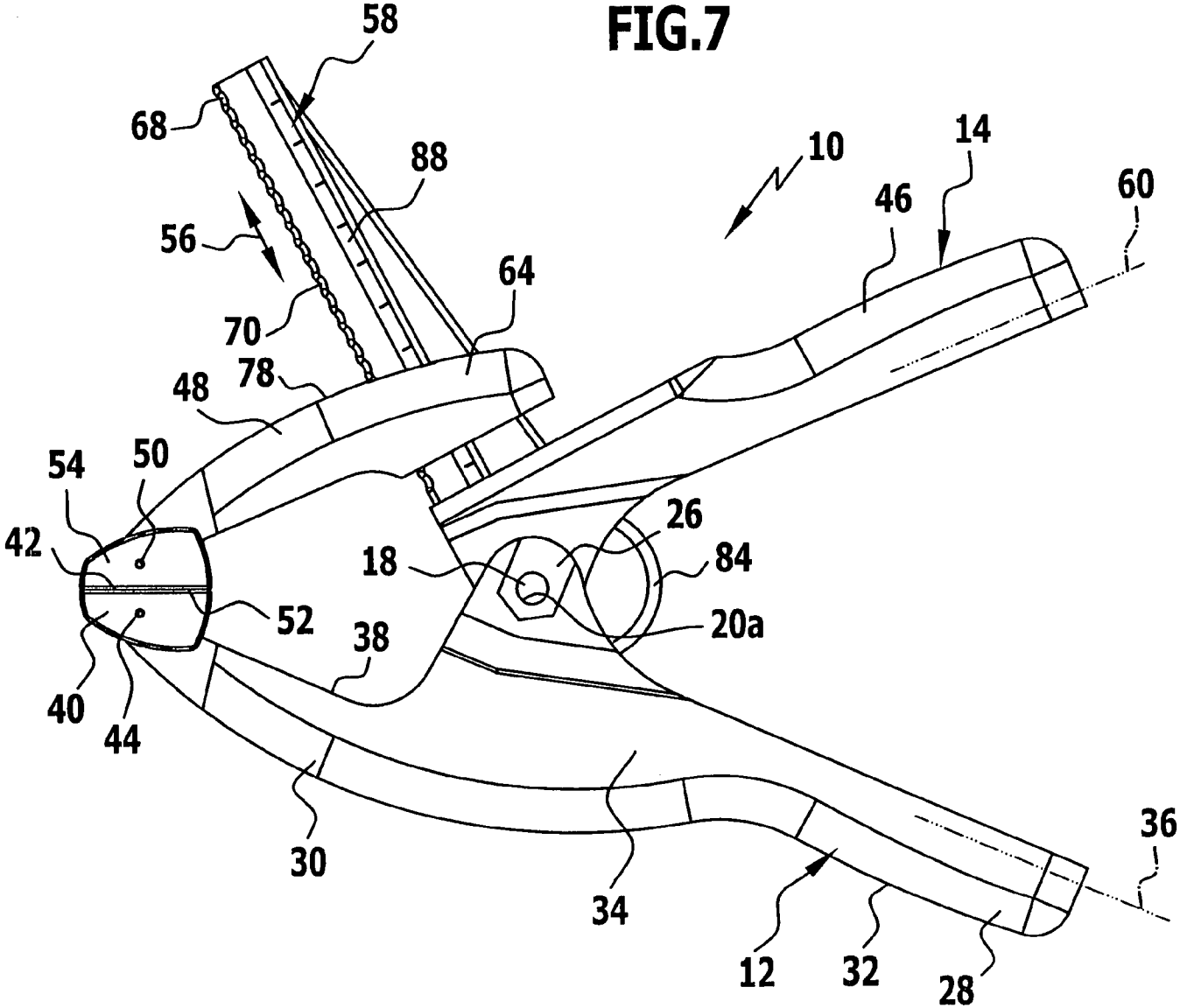
FIG. 7 the same view as FIG. 1 in another pivotal position of the arms and in another displaced position of a sliding bracket.

As an example, respective recesses 20*a*, 20*b* are formed in the first arm 12 and in the second arm 14 (c.f. FIG. 6), these recesses 20*a* and 20*b* being mutually aligned. The recess 20*a* in the first arm 12 is formed in respective oppositely located brackets 22*a*, 22*b* (c.f. FIGS. 1 to 5). The two brackets 22*a* and 22*b* are spaced apart. The second arm 14 incorporating a corresponding element 24, in which the recess 20*b* is formed (c.f. FIG. 6), is arranged between these two brackets.

A pin element is seated in the recesses 20*a*, 20*b* and serves as a pivotal shaft 18. Hereby, this pin element 18 is non-rotational relative to the first arm 12 and in particular it is non-rotational relative to the brackets 22*a*, 22*b*. To this end, each bracket comprises a depression 26 which is formed in such a manner that an appropriate element can be accommodated therein in non-rotational manner, said element being connected to the pivotal shaft 18.

The first arm 12 comprises a handle portion 28 and a jaw portion 30 which is connected thereto in one-piece manner. The external surface 32 of the handle portion 28 in particular has an ergonomic shape.

The handle portion 28 and the jaw portion 30 of the first arm 12 are connected by a connecting portion 34, the brackets 22*a*, 22*b* being seated on the connecting portion. In the exemplary embodiment shown here, the handle portion 28 extends in a longitudinal direction 36. The external surface 32 of the first arm 12 is curved outwardly from the handle portion 28. The inner side 38 opposite the external surface 32 has an L-shaped shape in the vicinity of the jaw portion 30.

A jaw piece 40 having a contact surface 42 for a work-piece is located near the end of the jaw portion 30 remote from the handle portion 28. This jaw piece 40 is arranged on the jaw portion 30 in moveable and, in particular, pivotal manner. The pivotal shaft 44 is in the form of a locking pin for example. The pivotal axis of the pivotal shaft 44 is aligned such that it is substantially parallel to the pivotal axis of the pivotal bearing 16.

The second arm 14 likewise comprises a handle portion 46 which is located opposite the handle portion 28 of the first arm 12. The handle portions 28 and 46 are formed in such a way and are positioned relative to one another in such a manner that an operator can grasp the handle portions 28, 46 with one hand and the handles 28, 46 can be pressed together.

The second arm 14 likewise comprises a jaw portion 48 (the second jaw portion). Again, a jaw piece 50 having a contact surface 52 for a work-piece is located at one end of this jaw portion 48. Yet again, this jaw piece 50 is preferably arranged on the jaw portion 48 in pivotal manner by means of a pivotal shaft 54.

A connecting line through the points of penetration of the pivotal shaft 44 in the first arm 12 and the pivotal shaft 54 in the second arm 14 is perpendicular relative to the pivotal axis of the pivotal bearing 18 and parallel to the direction of displacement 56 of the jaw portion 48 with respect to the second arm 14.

A slide rail 58 is seated in non-displaceable manner on the second arm 14, said rail being oriented transversely, and in particular, perpendicularly relative to the pivotal axis of the pivotal bearing 16 and also being oriented transversely, and in particular, perpendicularly relative to the longitudinal direction 60 of the handle portion of 46. The jaw portion 48 of the second arm 14 is guided in displaceable and fixable manner on this slide rail 58 so that the relative distance between the jaw portion 48 and the second arm 14 and thus the pivotal bearing 16 is adjustable in the direction of displacement 56.

The jaw portion 48 of the second arm 14 is in the form of a sliding bracket which is guided in displaceable manner along the slide rail 58.

The slide rail 58 is firmly connected to the handle portion 46. The connection can be effected in one-piece manner, or the arrangement may consist of two separate components which are subsequently fixed to one another.

For the purpose of guiding the sliding bracket (the jaw portion 48) along the slide rail 58, the slide rail 58 comprises one or more strip-like guidance profiles. In the exemplary embodiment shown here, the slide rail 58 comprises three spaced guide rails 62*a*, 62*b* and 62*c* (FIG. 2) which are arranged along the direction of displacement 56 and point towards that end of the jaw portion 48 which is remote from the end at which the jaw piece 50 is located.

The jaw portion 48 comprises a guidance portion 64 where the jaw portion 48 is seated on the slide rail 58. In turn, this guidance portion 64 comprises appropriate recesses 66*a*, 66*b* and 66*c* which accommodate the corresponding guide rails 62*a*, 62*b* and 62*c*.

Figure 3:
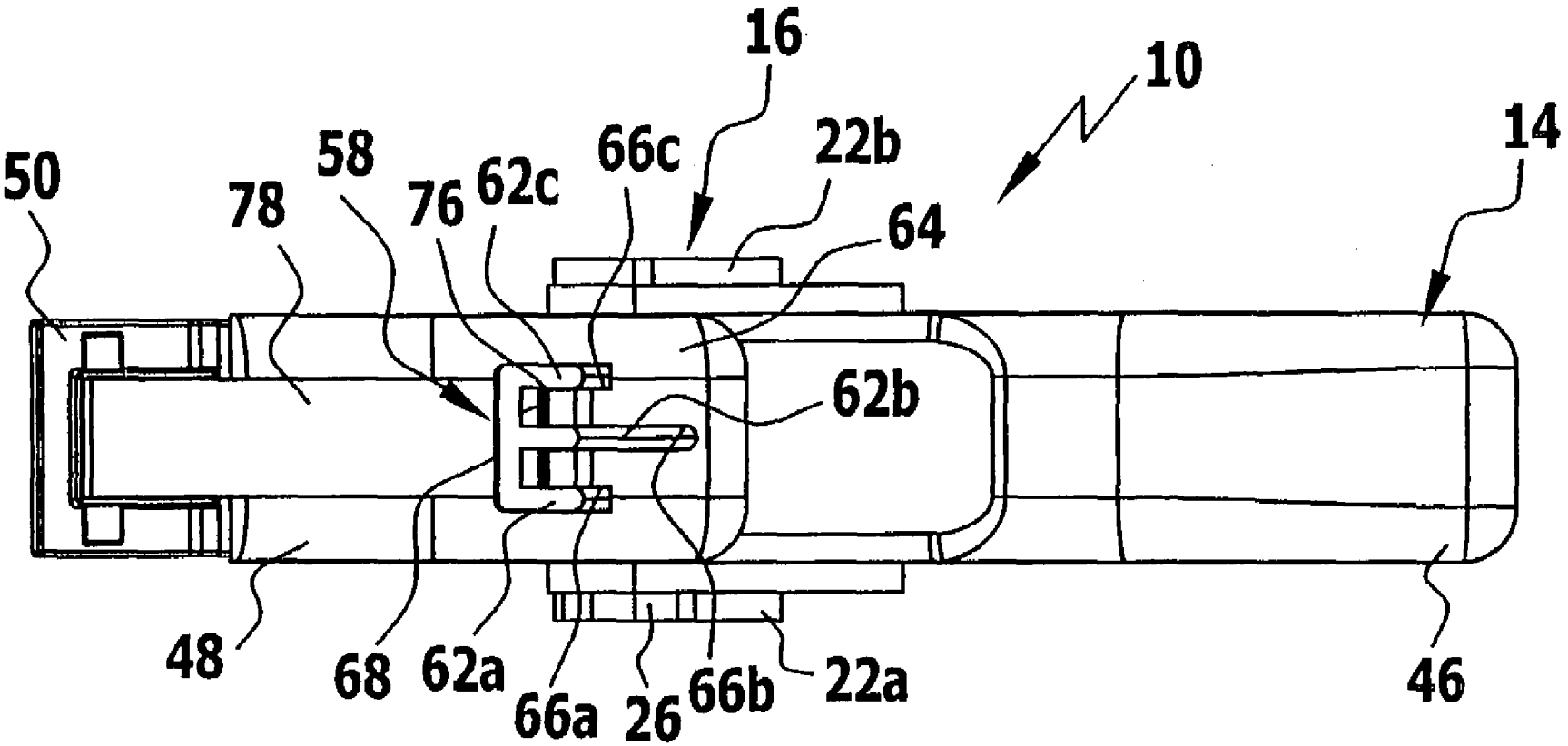
FIG. 3 a view of the clamp-type hand tool in accordance with FIG. 1 in the direction B.
Figure 4:
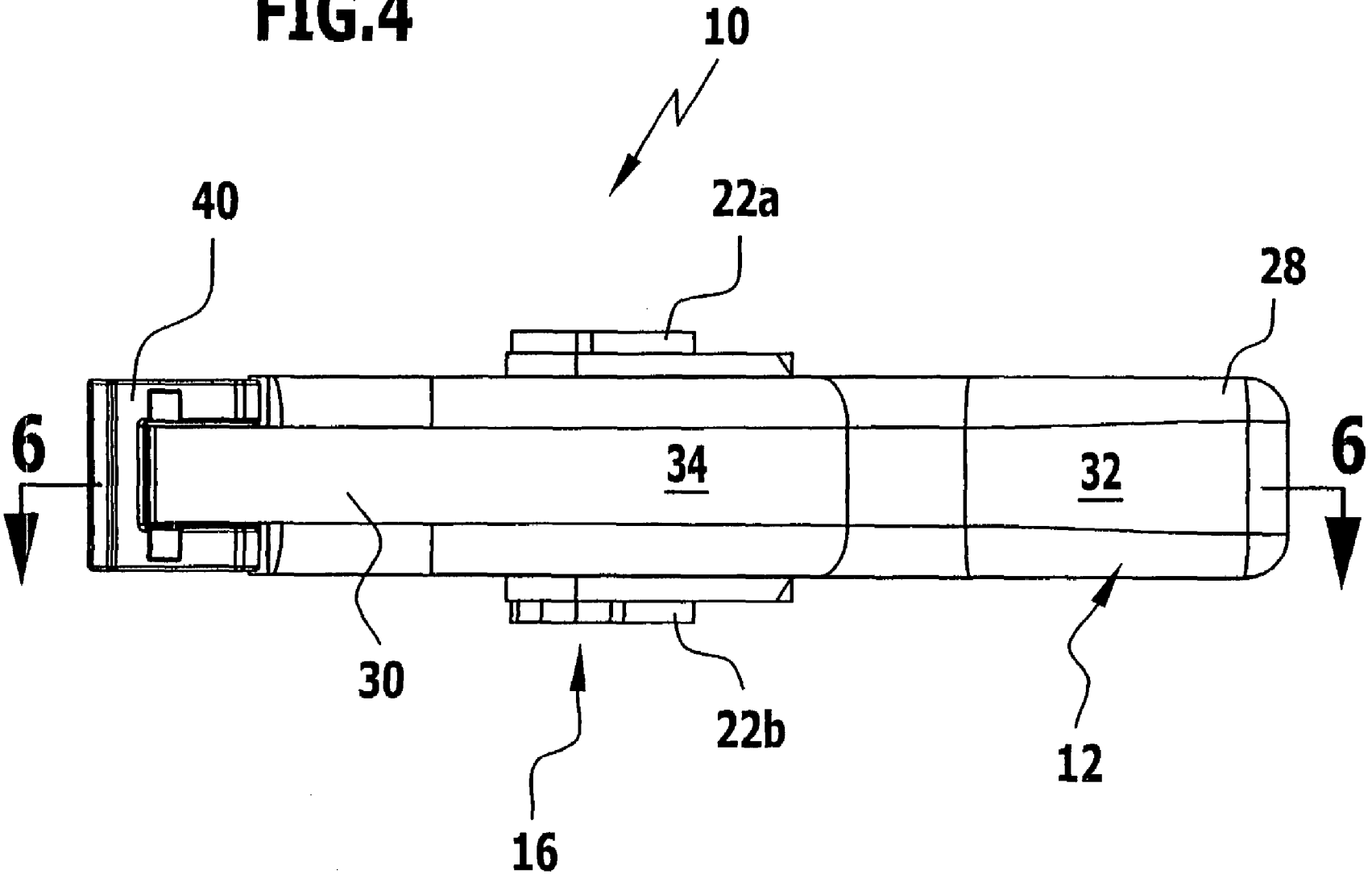
FIG. 4 a view of the clamp-type hand tool in accordance with FIG. 1 in the direction C.
Figure 5:
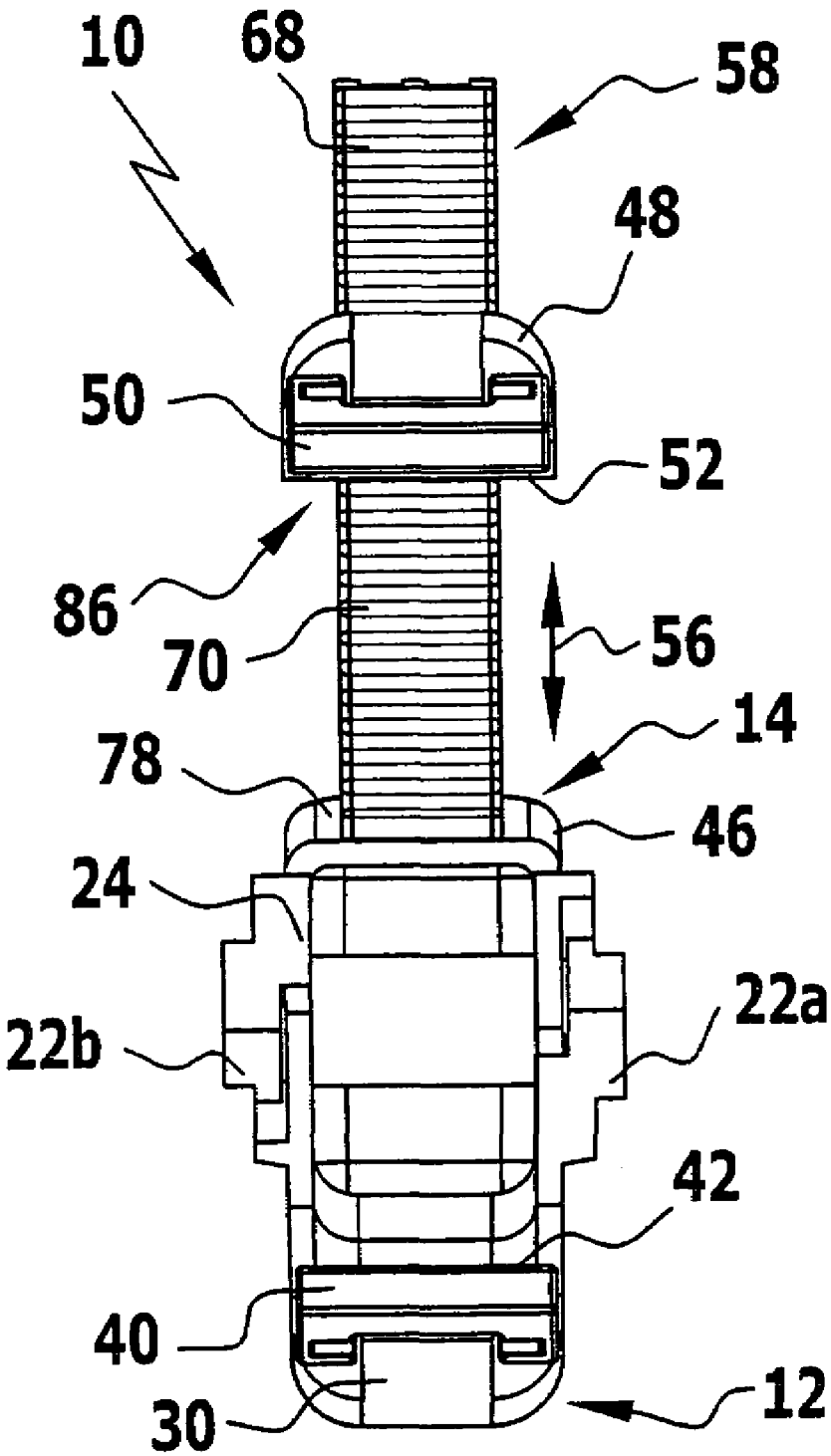
FIG. 5 a view of the clamp-type hand tool in accordance with FIG. 1 in the direction D.

Provision may be made for the middle guide rail 62*b* to be longer than the edge guide rails 62*a* and 62*c* (c.f. FIG. 3).

By virtue of the guidance portion 64 incorporating the recesses 66*a*, 66*b*, 66*c* and the matching guide rails 62*a*, 62*b*, 62*c*, it is ensured on the one hand that there will be adequate guidance of the sliding bracket 48 on the slide rail 58, whilst, on the other hand, it will be ensured that the jaw portion 48 cannot be removed from the slide rail 58 in a direction transverse to the direction of displacement 56.

On the external surface 68 of the slide rail 58 facing the jaw piece 50, the slide rail 58 comprises a row of seatings 70 for a latching element 72 (c.f. FIG. 6) of the jaw portion 48. The row of seatings 70 is, for example, in the form of a sort of wave profile wherein depressions, which repeat periodically in the direction of displacement 56, are provided on the external surface 68.

The latching element 72 of the jaw portion 48 can enter an appropriate seating 70. Consequently, the displacement process in the direction of displacement 56 can be blocked so that the jaw portion 48 will be held in a certain position spaced from the handle portion 46. In particular, this holding action is effected in substantially play-free manner.

A latching process is provided for holding the guidance portion 64 with respect to the slide rail 58. In particular, a clamping force is exerted which presses a latching element 72 that has entered an associated seating 70 into just this seating 70 and thereby effects this latching process.

To this end, in the exemplary embodiment shown here, the jaw portion 48 of the arm 14 comprises one or more elastic (resilient) elements, and in particular, one or more tongue elements 74 which are arranged on the jaw portion 48 in spring-like manner.

Such a tongue element 74 (c.f. FIG. 6) is effective on the side 76 of the slide rail 58 opposite the external surface 68 and presses against it. In turn, the latching element 72, which is seated in the appropriate seating 70, will thus be pressed into this seating 70 so that a movement in the direction of displacement 56 will be blocked. The latching element 72 can be released from the seating 70 by exerting a force transverse to the direction of displacement 56 in order to effect a displacement of the sliding bracket 48.

In particular, the at least one tongue element 74 is formed integrally with the jaw portion 48. It is, in particular, connected to the jaw portion 48 in one-piece manner. It extends, for example, away from the handle portion 46 and thereby projects beyond an external surface 78 of the jaw portion 48. It thus exerts a force which has a component parallel to the direction of displacement 56 and a component perpendicular to the direction of displacement 56, whereby the point 80 at which the force is applied is, taken with respect to the direction of displacement 56, preferably spaced from the latching element 72 of the jaw portion 48. This spacing relative to the pivotal bearing 16 in the direction of displacement 56 is thereby greater than the spacing between the latching element 72 and the pivotal bearing 16 in the direction of displacement 56.

In correspondence with the latching element 72, the seatings 70 are preferably formed such that the jaw portion 48 of the arm 14 will be pressed into a retaining position, in which the jaw portion 48 is held on the slide rail 58 in substantially play-free manner, by the force exerted by the at least one tongue element 74 (by virtue of the component of force parallel to the direction of displacement 56). To this end, the seatings 70 preferably comprise walls (indicated in FIG. 6 by the reference symbol 82) which are inclined with respect to the direction of displacement 56 and which cause the latching element 72 to be pressed into the lowest point of a hollow formed by a seating 70 in the manner of a potential minimum.

A spring 84 (FIGS. 1, 6 and 7), which is biased in such a manner that it is constrained to press the two arms 12, 14 apart (see FIG. 7), is located between the two arms 12 and 14. Without the exertion of any external force, the pivotal movement of the two arms 12, 14 is then limited by virtue of the two jaw pieces 40, 50 lying together (FIG. 7) or by virtue of the jaw pieces 40, 50 resting against a work-piece which is located between the two jaw portions 30, 48.

The two jaw portions 30, 48 form a jaw device 86 whose aperture size is adapted to be set by the relative pivotal position of the two arms 12, 14. In order to open the jaw, a force must be exerted by pressing the two arms 12, 14 towards one another. This force is exerted by an operator. If a work-piece is then inserted into the opened jaw device 86 and the force is eased to such an extent that the jaw pieces 40, 50 rest against the work-piece, then the spring 84 will exert an appropriate force for clamping the work-piece in the jaw device 86 by means of the jaw portions 30, 48.

Such a clamp-type hand tool is employed, for example, in connection with the gluing of wooden parts and is consequently referred to as a glue press or glue clamp.

The spring 84 may be in the form of a torsion spring or a leg spring for example.

The spring 84 comprises for example a first leg 85*a* and a second leg 85*b* (FIG. 6). Between these legs 85*a*, 85*b* a spring winding package 87 is formed. The spring winding package 87 has several windings and circumvenes the pivotal shaft 18; the pivotal shaft 18 is guided through an inner space of the spring winding package 87.

The spring 84 is held via its first leg 85*a* on the handle portion 28 of the first arm 12. The first arm 12 has for that an inner surface directed towards the second arm 14 and being bowl-shaped. On this inner surface, bridge elements are arranged at a distance from each other. In recesses of these bridge elements 89 the first leg 85*a* of the spring 84 is positioned and in particular is brazed.

The second leg 85*b* is positioned in the same manner on an inner surface of the handle part 46 of the second arm 14.

In accordance with the invention, provision is also made for the aperture size of the jaw device 86 to be set in an additional manner by the displacement of the jaw portion 48 on the slide rail 58. This thus likewise enables the clamping force, with which a work-piece is clamped between the two jaw pieces 40, 50, to be adjusted. If, for example, it is intended that a work-piece of given dimensions should be held by the clamp-type hand tool 10, then a certain sized aperture of the jaw device 86 can be obtained both by means of the pivotal position of the two arms 12, 14 and by means of the displaced position of the jaw portion 48. It is usually the case, that a relatively large force will be exerted when there is a small pivotal angle between the two arms 12 and 14 (indicated in FIG. 1). An operator can reduce this force by permitting a larger angle to exist between the two arms 12, 14 (i.e. providing for a smaller degree of pivot from the initial position), however the distance of the jaw portion 48 from the pivotal bearing 16 in the direction of displacement 56 will be increased.

Since the two jaw pieces 40 and 50 are arranged to be pivotal on their respective jaw portions 30, 48, provision is thereby made for them to be securely seated on the work-piece independently of the pivotal position of the two arms 12, 14 relative to one another.

Thus, for example, smaller clamping forces can be exerted in the case of more delicate work-piece surfaces.

Consequently, due to the clamp-type hand tool 10 in accordance with the invention, the force exerted for a given aperture of the jaw device 86 can be set by appropriate adjustment of the pivotal position of the two arms 12, 14 and by appropriate adjustment of the position to which the jaw portion 48 is displaced i.e. the force, which is exerted on the work-piece, can be proportioned.

In an analogous manner, a certain force on a work-piece, which it is intended should be kept clamped, can also be achieved with different apertures of the jaw device 86.

Provision may be made for a graduated scale 88 to be arranged on the slide rail 58 (FIG. 7) in order to enable a defined displaced position of the jaw portion 48 on the slide rail 58 to be set.

Usually, leg springs have a force-extension characteristic which is such that the force is under-proportionally smaller for a shorter movement of the spring than it is for a larger movement of the spring. This means, in the case of the clamp-type hand tools known from the state of the art, that a small and sometimes insufficient clamping force will be effective if the height dimension of the work-piece that is to be clamped is very small and, in particular, if it is flat. By virtue of the teaching in accordance with the invention, this problem can be eliminated by inserting the spring 84 in such a manner that, in a starting position at which the spring-segment has a zero-position, the jaw portion 48 will be positioned such that it is spaced from the handle portion 46. The same aperture can then also be achieved if the two arms 12, 14 are moved towards one another and the jaw portion 48 is moved towards the pivotal bearing 16. However, in this new relative pivotal position of the two arms 12, 14, a larger extension of the spring and thus a larger force is achieved so that there will be a larger effective force for the same aperture of the jaw device 86. Consequently, by virtue of the teaching in accordance with the invention, conventional springs 84 can be used, but a higher clamping force can still be obtained for small apertures without even having to change the spring 84 itself.

The arms 12, 14 can, in principle, be made of a metallic material. However, it is also possible to make the arms 12, 14 of a synthetic material.

The clamp-type hand tool 10 has a displaceable jaw portion, namely the jaw portion 48, whilst the jaw portion 30 is firmly connected to the first arm 12. In principle however, it is also possible for both jaw portions 30, 48 to be displaceable on the appertaining arms 12, 14.

Figure 8:
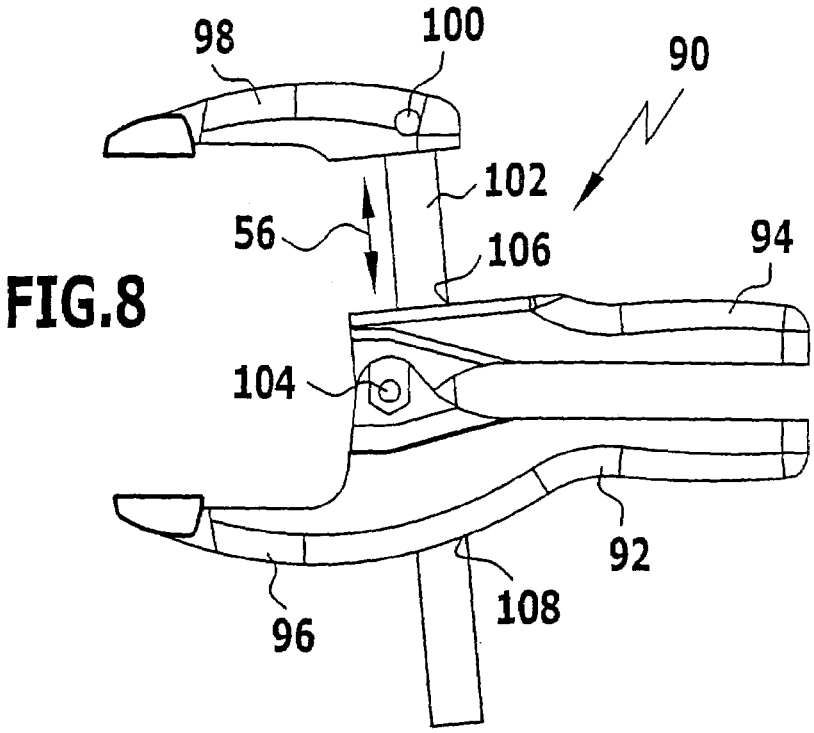
FIG. 8 a plan view of a second exemplary embodiment of a clamp-type hand tool in accordance with the invention and FIG. 9 a plan view of a third exemplary embodiment of a clamp-type hand tool in accordance with the invention.

In a second exemplary embodiment of a clamp-type hand tool in accordance with the invention, which is shown in FIG. 8 and bears the general reference 90 therein, there are provided a first arm 92 and a second arm 94 which are basically constructed as described hereinabove, whereby they comprise respective jaw portions 96 and 98. The jaw portion 98 of the second arm 94 is seated firmly on a slide rail 102, for example, by means of a bolted connection 100. This slide rail 102 is displaceable with respect to the arms 92, 94 in the direction of displacement 56 so that the distance of the jaw portion 98 from a pivotal bearing 104 used for the purposes of pivoting the two arms 92, 94 is adjustable in this way.

In order to enable the slide rail 102 to be displaced on the arms 92, 94, the arm 94 comprises a recess 106 into which the slide rail 102 has entered. This recess 106 serves as a guidance recess for the slide rail 102 just for the purposes of enabling it to be displaced with respect to the second arm 94. The arm 92 may comprise a recess 108 which, in particular, is designed to provide a clearance for enabling the slide rail 102 to be displaced relative to the first arm 92 and to enable the two arms 92, 94 to be pivoted.

The slide rail 102 is adapted to be displaced and fixed with respect to the arm 94. The recess 108 is formed in such a way as to ensure that the two arms 92, 94 will still be able to pivot relative to one another when there is a slide rail 102 on the second arm 94.

The fixing of the slide rail 102 for the purposes of setting a certain spacing position of the jaw portion 98 with respect to the pivotal bearing 104 can, for example, be effected by one or more clamping-force-producing elements as was described hereinabove in connection with the first exemplary embodiment. For example, the first arm 94 may be provided with one or more springy elements which are effective on the slide rail 102 in order to keep it substantially free from play in a certain displaced position, whereby these displaced positions are adjustable.

In the exemplary embodiment in accordance with FIGS. 1 to 7, the relative displacement of the jaw portion 48 with respect to the associated arm 14 is achieved by virtue of the jaw portion 48 being displaceable on a slide rail 58 which is firmly connected to the arm 14. In the exemplary embodiment in accordance with FIG. 8, the relative displacement of the jaw portion 98 with respect to the associated arm 94 is achieved by virtue of the jaw portion 98, which is firmly attached to the slide rail 102, being moveable with the slide rail 102 which itself is displaceable with respect to the arm 94.

In principle, a combination of these two methods of displacement is possible, namely, that one jaw portion is guided in displaceable manner on a slide rail and, in turn, the slide rail itself is displaceable and is displaceable on the associated arm.

Figure 9:
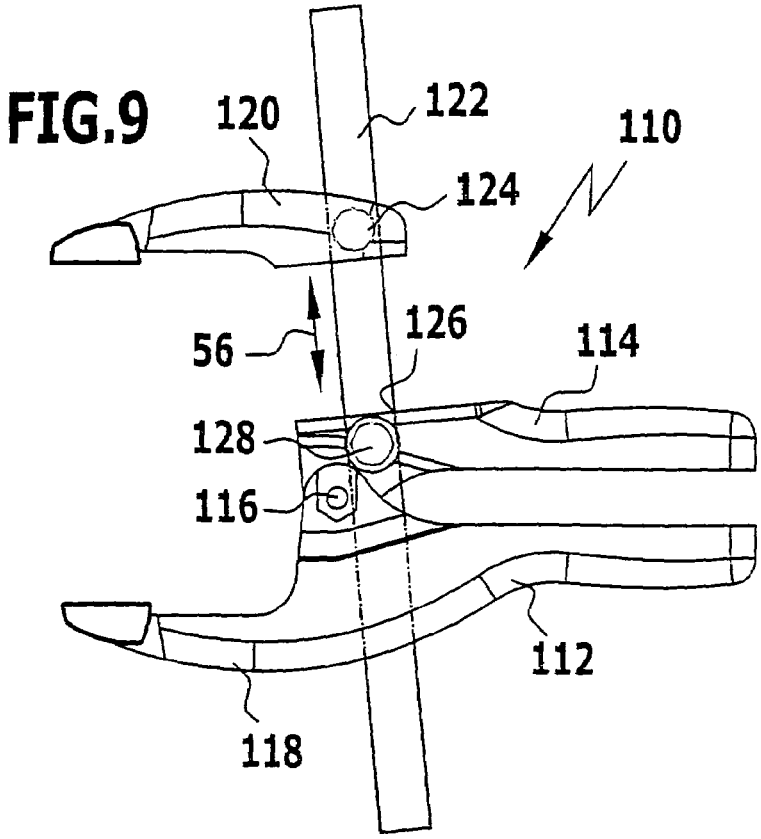

In a third exemplary embodiment which is depicted in FIG. 9 and bears the general reference 110 therein, there are provided a first arm 112 and a second arm 114. These are pivotal relative to one another by means of a pivotal bearing 116. The first arm 112 comprises a jaw portion 118 and the second arm 114 comprises a jaw portion 120. This jaw portion 120 is in the form of a sliding bracket similar to the jaw portion 48 in accordance with the first exemplary embodiment and is adapted to be displaced and fixed on a slide rail 122. Hereby, the fixing action can be implemented by means of clamping-force-exerting elements as was described in connection with the first exemplary embodiment.

An additional frictional fixing arrangement 124 may also be provided in order to positively fix the jaw portion 120 to the slide rail 122 so that displacement along the slide rail 122 will be blocked.

The second arm 114 comprises a seating 126 into which the slide rail 122 has entered and in which it is adapted to be displaced and fixed.

The slide rail 122 is adapted to be fixed on the second arm 114, in particular, by means of a positive connection 128.

If the jaw portion 120 is fixed on the slide rail 122 by means of the frictional fixing arrangement 124 and the slide rail 122 is fixed on the arm 114 by means of the positive connection 128, then the size of the aperture can only be set by means of the relative pivotal position of the two arms 112, 114.

If the positive fixing arrangement 124 is released, then the relative position of the jaw portion 118 can be set by displacing it along the slide rail 122, whereby the jaw portion 118 will be held in substantially play-free manner in certain positions of displacement, for example, by a clamping force.

If the positive connection 128 is released, then the relative position of the jaw portion 120 with respect to the pivotal bearing 128 can be set by displacing the slide rail 122 relative to the second arm 114, whereby the relative positions of displacement will be maintained in substantially play-free manner, for example, by a clamping force.

What is claimed is:

1. A clamp-type hand tool, comprising:

a first arm with a corresponding jaw portion; and a second arm with a corresponding jaw portion;

wherein:

the two arms are pivotable relative to one another;

the jaw portions form a jaw device having an adjustable aperture; and at least one of: (i) the jaw portions of the first arm is displaceable on the first arm and (ii) the jaw portion of the second arm is displaceable on the second arm.

2. A clamp-type hand tool in accordance with claim 1, wherein the displaceable jaw portion is displaceable away from the other jaw portion or is displaceable towards the other jaw portion.

3. A clamp-type hand tool in accordance with claim 1, wherein the size of the aperture of the jaw device is adjustable by means of the displaceable jaw portion.

4. A clamp-type hand tool in accordance with claim 1, wherein the clamping force effective on one or more work-pieces that are clamped in the jaw is adjustable by means of the displaceable jaw portion.

5. A clamp-type hand tool in accordance with claim 1, wherein the displaceable jaw portion is adapted to be displaced and fixed on the corresponding arm.

6. A clamp-type hand tool in accordance with claim 1, wherein the direction of displacement of the displaceable jaw portion is transverse to a pivot axis for the first arm and the second arm.

7. A clamp-type hand tool in accordance with claim 1, wherein the direction of displacement of the displaceable jaw portion is transverse to the longitudinal direction of a handle portion of the corresponding arm.

8. A clamp-type hand tool in accordance with claim 1, wherein a slide rail is provided for the displaceable jaw portion.

9. A clamp-type hand tool in accordance with claim 8, wherein the slide rail extends transversely relative to a handle portion of the corresponding arm.

10. A clamp-type hand tool in accordance with claim 8, wherein the slide rail is connected to a handle portion of the corresponding arm.

11. A clamp-type hand tool in accordance with claim 8, wherein the displaceable jaw portion is in the form of a sliding bracket which is guided on the slide rail.

12. A clamp-type hand tool in accordance with claim 11, wherein the sliding bracket is fixable on the slide rail in releasable manner by means of a clamping force.

13. A clamp-type hand tool in accordance with claim 12, wherein one or more elastic elements are provided in order to hold the sliding bracket on the slide rail.

14. A clamp-type hand tool in accordance with claim 13, wherein at least one springy tongue element is provided which presses the sliding bracket on to the slide rail.

15. A clamp-type hand tool in accordance with claim 14, wherein the tongue element is arranged on the sliding bracket.

16. A clamp-type hand tool in accordance with claim 15, wherein the tongue element is formed in a one-piece manner with the sliding bracket.

17. A clamp-type hand tool in accordance with claim 9, wherein the sliding bracket comprises at least one latching element and the slide rail comprises matching seatings, whereby a displacement of the sliding bracket is blocked if the at least one latching element has entered into a seating.

18. A clamp-type hand tool in accordance with claim 17, wherein a row of seatings is provided along the slide rail in the direction of displacement.

19. A clamp-type hand tool in accordance with claim 17, wherein the seatings and a surface, upon which a force-exerting element is effective, are arranged at opposite sides of the slide rail.

20. A clamp-type hand tool in accordance with claim 17, wherein the seatings have side faces which are inclined with respect to the direction of displacement.

21. A clamp-type hand tool in accordance with claim 8, wherein the slide rail is provided with a graduated scale.

22. A clamp-type hand tool in accordance with claim 8, wherein the slide rail is arranged on the corresponding arm in fixable and displaceable manner.

23. A clamp-type hand tool in accordance with claim 22, wherein the displaceable jaw portion is firmly seated on the displaceable slide rail.

24. A clamp-type hand tool in accordance with claim 22, wherein the displaceable jaw portion is seated on the displaceable slide rail in a fixable and displaceable manner.

25. A clamp-type hand tool in accordance with claim 22, wherein the corresponding arm comprises a guidance recess for the slide rail.

26. A clamp-type hand tool in accordance with claim 1, wherein a spring is arranged between the first arm and the second arm.

27. A clamp-type hand tool in accordance with claim 26, wherein the spring is arranged and constructed in such a manner that an external force must be expended in order to pivot the arms relative to one another when enlarging the aperture of the jaw device.

28. A clamp-type hand tool in accordance with claim 26, wherein the spring is arranged and constructed in such a manner that the arms exert a clamping force on one or more work-pieces which are located between the jaw portions of the two arms.

29. A clamp-type hand tool in accordance with claim 1, wherein a jaw piece for a work-piece is arranged, in moveable manner, on the jaw portion of at least one of the first arm and the second arm.

* * * * *